US006212859B1

(12) United States Patent
Bielik, Jr. et al.

(10) Patent No.: US 6,212,859 B1
(45) **Date of Patent: *Apr. 10, 2001**

(54) PACKAGING MACHINE WITH ROTARY TOP SEALER

(75) Inventors: Richard Bielik, Jr., Palos Park; Robert Czolek, Chicago; Adam Dworak, Northbrook; Robert Anderson, Huntley; August Zurawski, Elmhurst; Charles E. Cloud, Northbrook, all of IL (US)

(73) Assignee: Cloud Corporation, LLC, Des Plaines, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/081,118

(22) Filed: May 19, 1998

(51) Int. Cl.[7] ..... B65B 43/04; B31B 1/64

(52) U.S. Cl. ..... 53/455; 53/374.4; 53/374.5; 53/450; 53/479; 53/550; 53/562; 493/205; 493/208

(58) Field of Search ..... 53/455, 450, 479, 53/550, 562, 374.3, 374.4, 371.4, 374.5, 374.6; 493/208, 205

(56) References Cited

U.S. PATENT DOCUMENTS

| | | | | |
|---|---|---|---|---|
| 2,655,777 | | 10/1953 | Hagen . | |
| 3,158,973 | | 12/1964 | Monaghan . | |
| 3,237,371 | | 3/1966 | Gerlach . | |
| 3,328,936 | | 7/1967 | Billeb . | |
| 3,505,776 | * | 4/1970 | Cloud | 53/562 |
| 3,552,088 | | 1/1971 | Niwa . | |
| 3,597,898 | * | 8/1971 | Cloud | 53/562 |
| 3,720,565 | | 3/1973 | Cavanna . | |
| 3,995,407 | | 12/1976 | Segale et al. . | |
| 4,219,988 | | 9/1980 | Shanklin et al. . | |
| 4,232,504 | * | 11/1980 | Dieterlen et al. | 53/562 |
| 4,288,967 | | 9/1981 | Seko et al. . | |
| 4,344,269 | | 8/1982 | Dieterlen et al. . | |
| 4,380,446 | * | 4/1983 | Dickson et al. | 493/208 |
| 4,597,240 | | 7/1986 | Scully . | |
| 4,696,147 | | 9/1987 | Noh . | |
| 4,712,357 | | 12/1987 | Crawford et al. . | |
| 4,783,950 | | 11/1988 | Santagati . | |
| 4,798,038 | | 1/1989 | Litt . | |
| 4,858,416 | | 8/1989 | Monaghan . | |
| 4,909,356 | | 3/1990 | Rimondi et al. . | |

(List continued on next page.)

*Primary Examiner*—Peter Vo
*Assistant Examiner*—Louis Huynh
(74) *Attorney, Agent, or Firm*—Charles F. Meroni, Jr.; Meroni & Meroni, P.C.

(57) ABSTRACT

A method of continuously forming, filling and sealing of packages with a continuous web of film material is disclosed and comprises the steps of providing a continuous web of film material and folding the web to provide confronting sides joined along a bottom edge and forming a vertical seal at spaced intervals along the web. This process forms a series of horizontally disposed pouches having opposed sidewalls separated by the vertical seals with each pouch being unsealed along a top edge. The pouches are then opened by separating the opposed sidewalls and are then filled with a product. After the pouches are filled, the top edge of each pouch is sealed together to enclose the filled pouches by training the pouches onto a horizontal rotary sealer having a heated circular sealer plate and progressively forming a continuous horizontal seal as the top edge of each pouch is being continuously moved along with a circumference of the heated circular sealer plate while at the same time applying an adequate temperature to provide a sealing action and allowing the top edge of each pouch to be joined together and smoothly sealed to enclose the filled pouches. This sealing method enables the packages to receive a greater amount of fill while still being able to provide a smooth, uniform seal.

51 Claims, 9 Drawing Sheets uspat

U.S. PATENT DOCUMENTS

| | | | | |
|---|---|---|---|---|
| 4,914,889 | | 4/1990 | Francioni . | |
| 4,924,657 | | 5/1990 | Berti et al. . | |
| 5,174,088 | * | 12/1992 | Focke et al. | 53/455 |
| 5,184,447 | * | 2/1993 | Johnsen | 53/374.4 |
| 5,335,478 | * | 8/1994 | Aronsen | 53/455 |
| 5,502,952 | * | 4/1996 | Wildmoser | 53/455 |
| 5,699,653 | * | 12/1997 | Hartman et al. | 53/562 |
| 5,875,610 | * | 3/1999 | Yuyama et al. | 53/374.4 |

* cited by examiner

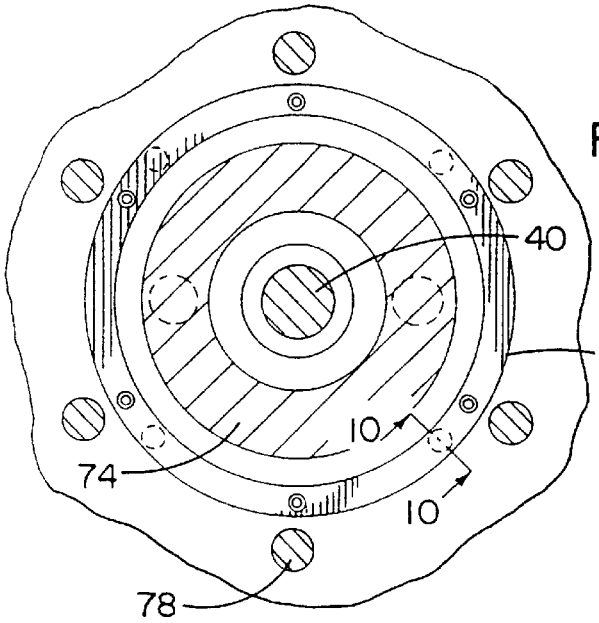
FIG. 9
FIG. 10
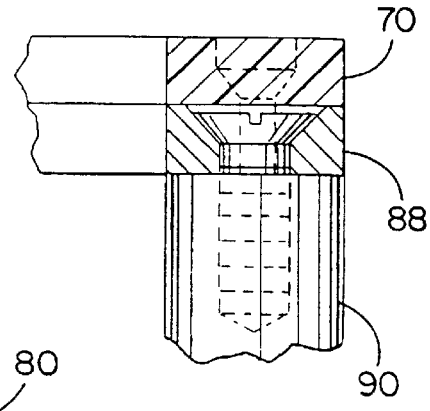
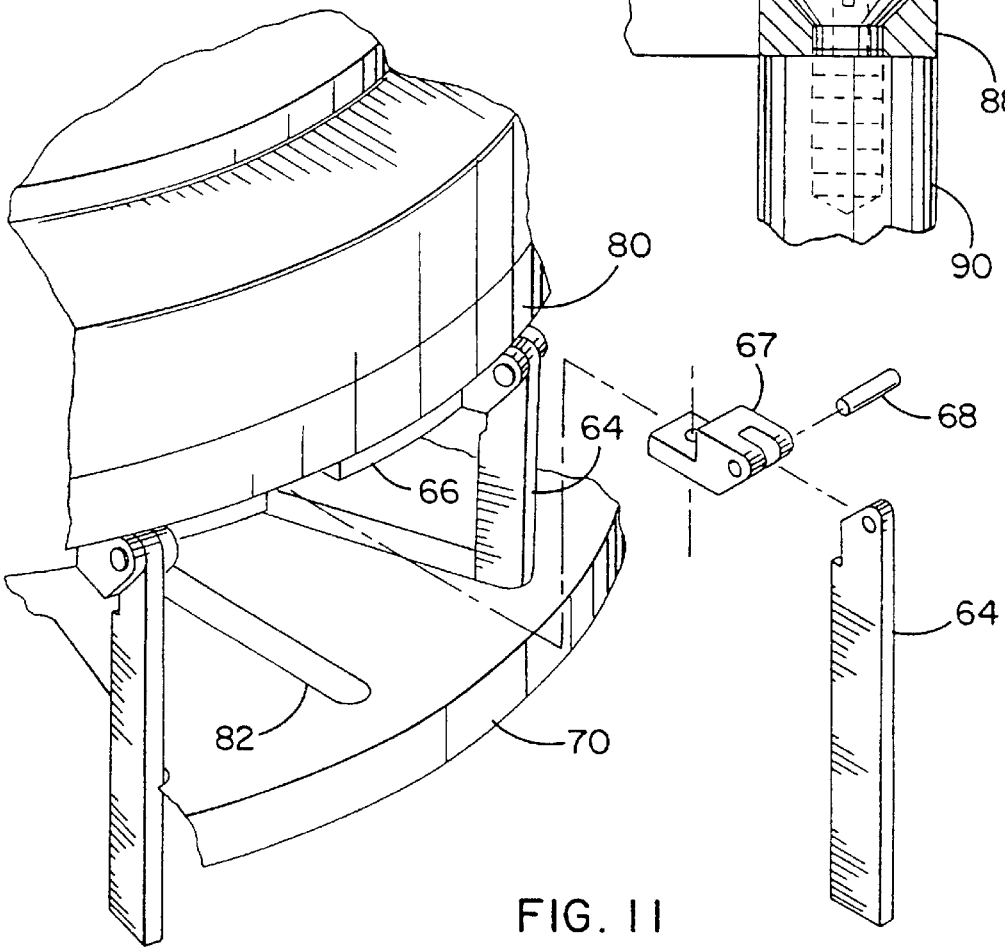
FIG. 11

PACKAGING MACHINE WITH ROTARY TOP SEALER

BACKGROUND OF THE INVENTION

1. Field of the Invention

The present invention relates generally to an improved packaging machine concerning the method and apparatus for continuously forming, filling and sealing packages while linked together to a continuous web of material. More specifically the present invention provides an improved horizontal top sealer that allows packages to hold a greater volume of fill while providing a smooth, uniform seal across the top horizontal edge.

2. Description of the Prior Art

Various prior art packaging machine devices are known in the art. In general, packaging machines are categorized into horizontal and vertical machines depending on the general direction of movement of a continuous web of material. The present invention relates to a horizontal packaging machine with an improved horizontal rotary top sealer and is designed to operate in a continuous manner.

In the manufacturing and production of packaged goods, cost factors are highly related to the costs of materials used in the packaging process. In the group of materials commonly found in continuous webs of film material: PET and polyethylene, and paper-polyethylene have heat sealable synthetic films that have a relatively low cost in comparison to other film materials. With these principles in mind, the present machine was developed to produce fusible film packages on a large production basis to be used for packaging products such as food powders, small candies, and the like. The machine and method further enables packages to be formed having a further expanded capacity for receiving an even greater volume of fill than prior packaging methods.

A number of U.S. patents have issued to a couple of the above-identified inventors concerning various packaging machine methods and apparatuses, with the following list being only a brief representative list of some issued patents to serve as additional background information in the field of continuously operating horizontal packaging machines:

| U.S. Pat. No. | Inventor | Date of Issue |
|---|---|---|
| 3,453,799 | Cloud et al. | July 8, 1969 |
| 3,478,492 | Cloud et al. | November 18, 1969 |
| 3,505,776 | Cloud | April 14, 1970 |
| 3,597,898 | Cloud | August 10, 1971 |
| 3,667,188 | Benner and Cloud | June 6, 1972 |
| 5,094,657 | Dworak and Cloud | March 10, 1992 |
| 5,722,217 | Cloud | March 3, 1998 |

These and other types of packaging machines used in the past do not offer the flexibility and inventive features of our packaging machine with a rotary top sealer. As will be described in greater detail hereinafter, the method and apparatus of the present invention differs from those previously proposed and employs a number of novel features that render it highly advantageous over the prior art.

SUMMARY OF THE INVENTION

The present invention relates to a horizontal packaging machine with a rotary top sealer and is designed to operate in a continuous manner utilizing a continuous web of film material for automatically forming, filling and sealing packages.

Accordingly, it is an object of this invention to provide an improved method and apparatus for manufacture of filled packages from a continuous web of material, which packages are formed, filled and sealed using a rotary top sealer while linked together to the web.

Another object of this invention is to provide an improved method and apparatus for manufacture of filled packages made from oriented polymers such as polypropylene, nylon, and polyester with seals that do not exhibit distortion wrinkles, and more particularly providing a rotary top sealer that allows the filled packages to hold a greater volume of fill while still providing a uniform, smooth seal across the top edge of the filled packages.

To achieve the foregoing and other objectives, and in accordance with the purposes of the present invention, a method and apparatus of continuously forming, filling and sealing of packages with a continuous web of film material is provided. The method includes the steps of providing a continuous web of film material and folding the web to provide confronting sides joined along a bottom edge, then forming a vertical seal at spaced intervals along the web thereby providing a series of horizontally disposed adjoining pouches having opposed sidewalls with each pouch unsealed along a top edge. The pouches are then opened by separating the opposed sidewalls and then the pouches are filled with a material. The top edge of each pouch is then sealed to close the filled pouches by training the pouches onto a horizontal rotary sealer having a heated circular sealer plate and progressively forming a continuous horizontal seal as the top edge of each pouch is being continuously moved along with a circumference of the heated circular sealer plate while at the same time applying an adequate temperature to provide a sealing action and allowing the top edge of each pouch to be joined together and smoothly sealed to enclose the filled pouches.

In accordance with an aspect of the invention, the horizontal rotary seal former has a heated circular sealer plate mounted for rotation. The heated circular sealer plate has a flat outer surface positioned about its circumference for engagement with an upper portion of the pouches for progressively forming a continuous horizontal seal as the web is continuously moved along with the circumference of the heated circular sealer plate while at the same time applying an adequate temperature to provide a sealing action and allowing the upper portion of the pouches to be joined together and smoothly sealed.

Still another feature of this invention concerns the horizontal rotary seal former as described above, wherein the horizontal rotary seal former further includes a land plate and a plurality of lands, the land plate has a diameter slightly smaller than the heated circular sealer plate and is positioned directly below the heated circular sealer plate. The land plate is mounted in corresponding rotation with the heated circular sealer plate, each of the lands has a relatively rectangular shape and has a thickness less than a thickness of the vertical seals on the series of horizontally disposed pouches. The plurality of lands are pivotally mounted at an upper end along the outer edge of the land plate allowing each of the lands to freely pivot radially inward and extend vertically downward from the land plate. The plurality of lands are equally spaced about the circumference of the land plate wherein the distance between each land is equivalent to the distance between the vertical seals on the series of horizontally disposed filled pouches, whereby when the web of horizontally disposed pouches are trained onto the horizontal seal former to join and seal the upper portion of the pouches, the vertical seals extending below the upper edge of the filled pouches will engage with the lands and curve radially inward in engagement with the lands, thereby helping to keep the horizontally disposed pouches properly aligned.

Yet another feature of the present invention concerns the packaging apparatus as described above, wherein the horizontal rotary seal former further includes a land stop, the land stop acts to stop each of the lands from pivoting radially inward beyond a predetermined distance.

A still further feature of the invention concerns the packaging apparatus as described above, wherein the horizontal rotary seal former further includes a bottom plate. The bottom plate has a diameter equivalent to the heated circular sealer plate and is mounted in corresponding rotation with the heated circular sealer plate. The bottom plate is positioned a predetermined distance below the heated circular sealer plate to allow the bottom edge of the horizontally disposed pouches to rest thereon.

An even further feature of the invention concerns the packaging apparatus as described above, wherein the position of the bottom plate in the horizontal rotary seal former is adjustable at varying heights to accommodate pouches of varying lengths.

Yet still another feature of the invention concerns the packaging apparatus as described above, further comprising at least one press roller mounted for counter-rotation in pressing engagement against the rotating circumference of the flat outer surface of the heated circular sealer plate in order to help seal and align the upper portion of the web of horizontally disposed pouches.

Other objects, features and advantages of the invention will become more readily apparent upon reference to the following description when taken in conjunction with the accompanying drawings, which drawings illustrate several embodiments of the invention.

DESCRIPTION OF THE DRAWINGS

FIG. 9 is a fragmentary top plan view of the rotary top sealer as taken along line 9—9 of FIG. 5;

FIG. 10 is an enlarged partial cross-sectional side view illustrating the connection of the wear plate to the hydraulic cylinders taken along line 10—10 of FIG. 9;

FIG. 11 is an enlarged partial perspective view of the rotary top sealer illustrating how the lands are connected to the land plate;

DETAILED DESCRIPTION OF THE PREFERRED EMBODIMENT

Figure 1:
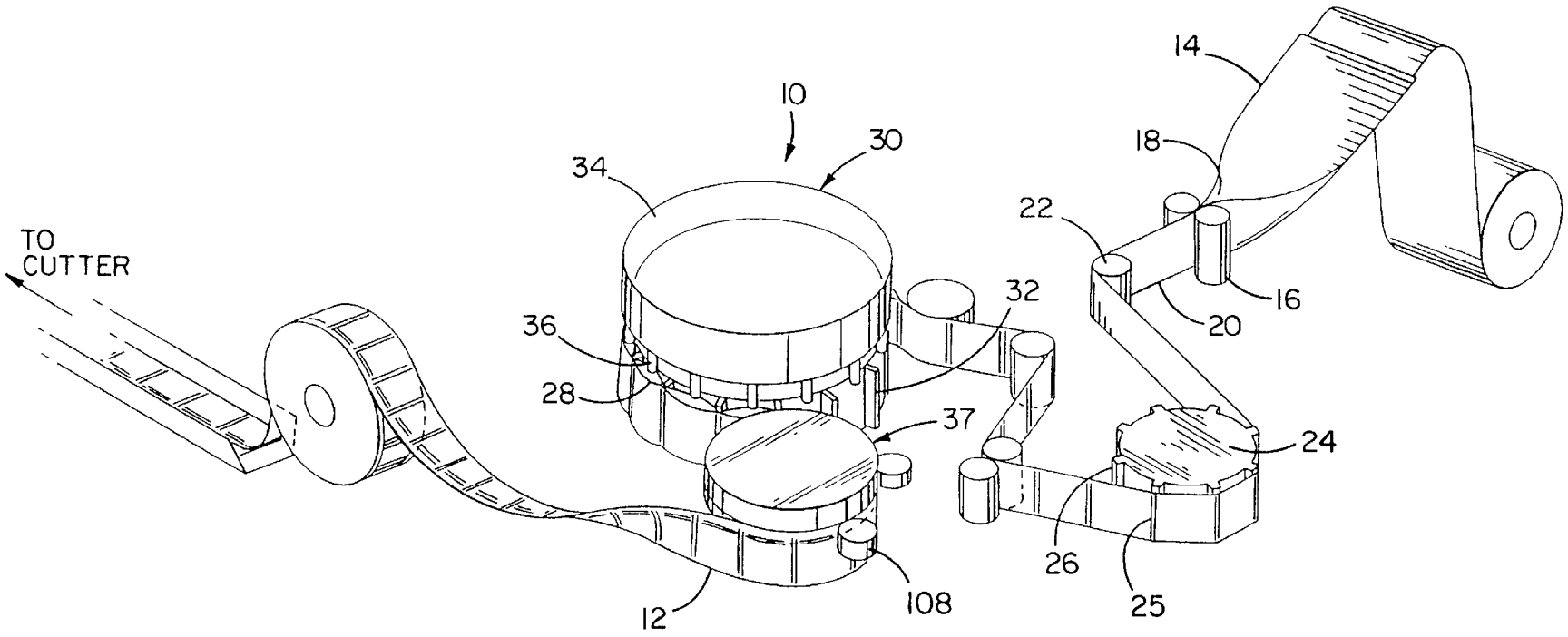
FIG. 1 is a diagrammatic perspective view of the present invention.

Referring now to the drawings, a packaging machine 10 is illustrated in FIG. 1. The present machine 10 is a horizontal type packaging machine and is capable of producing filled packages 12 at a high rate of production. The packages 12 are produced from a continuous strip or web of film material 14 or from several continuous webs of laminated film materials, as desired. The web is formed of film materials such as: PET and polyethylene; paper-polyethylene; or any other types of sealable film material, which provides for an inexpensive packaging material. Additionally, the web may be pre-printed.

A coiled roll of the continuous web 14 of film material is initially provided. A suitable strip plow 16 acts to fold the web 14 to provide confronting sides 18 joined along a bottom edge 20 of the web 14. A guide roller 22 then directs the web onto a rotating vertical seal former 24 to form a plurality of vertical seals 25 extending from the bottom edge of the web to the top edge of the web. The vertical seal former has a plurality of elongated circumferentially spaced vertical sealers 26 located at an outside surface of the vertical seal former 24, as best illustrated in FIG. 1.

In order to form vertical seals 25, the web 14 is pressed against the elongated circumferentially spaced vertical sealers 26 to progressively form vertical seals 25 as the web is being continuously moved with the rotating vertical seal former 24 while at the same time applying an adequate temperature to provide a sealing action and allowing the area of the film being sealed to be progressively formed or cooked. As the vertical seals are formed, the confronting sides 18 of the web 14 are melted together along the area of the vertical sealers 26, with the vertical sealers then melting through the web 14 to form a vertical seal 25 along each adjacent side of the vertical sealers 26. Once the vertical seals 25 have been completed, a series of horizontally disposed pouches 28 have been produced. It is to be understood that other types of pouch creating methods can be employed with the features of the present invention.

Figure 2:
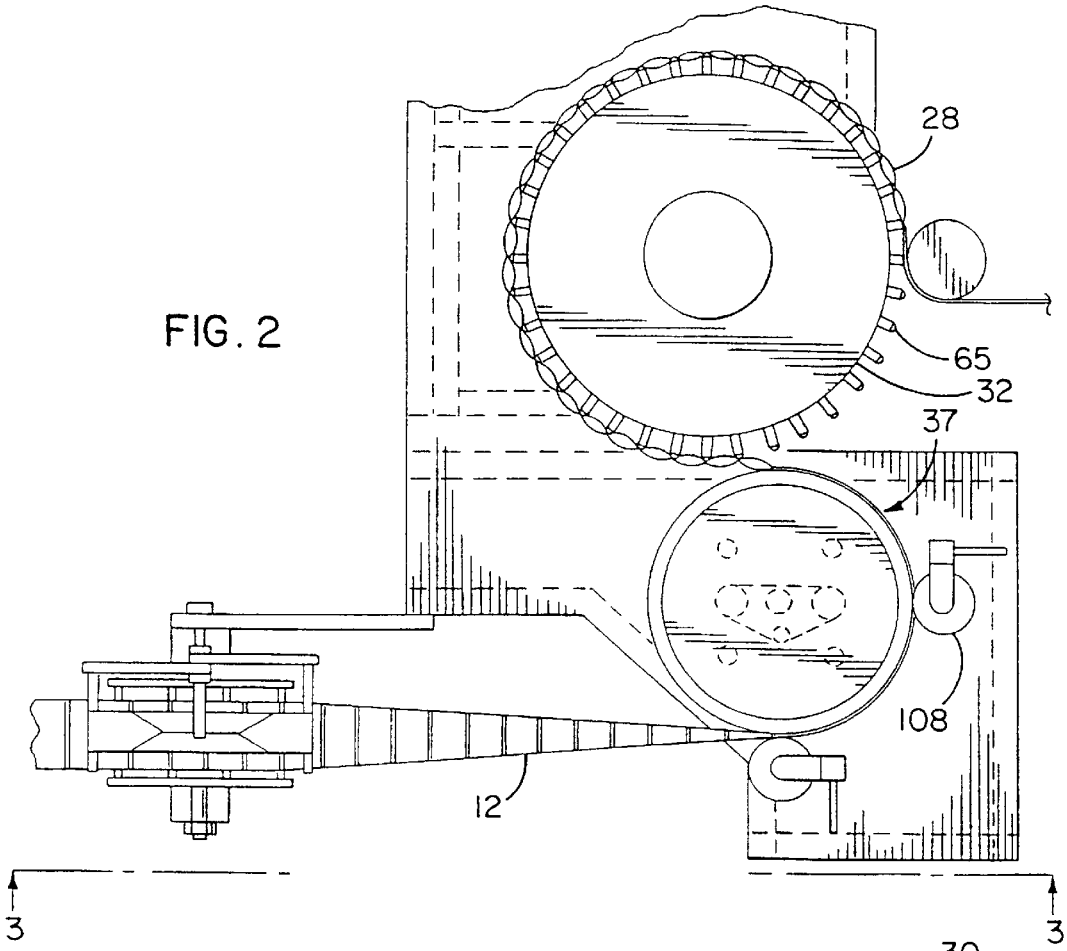
FIG. 2 is a top plan view of the present invention.
Figure 3:
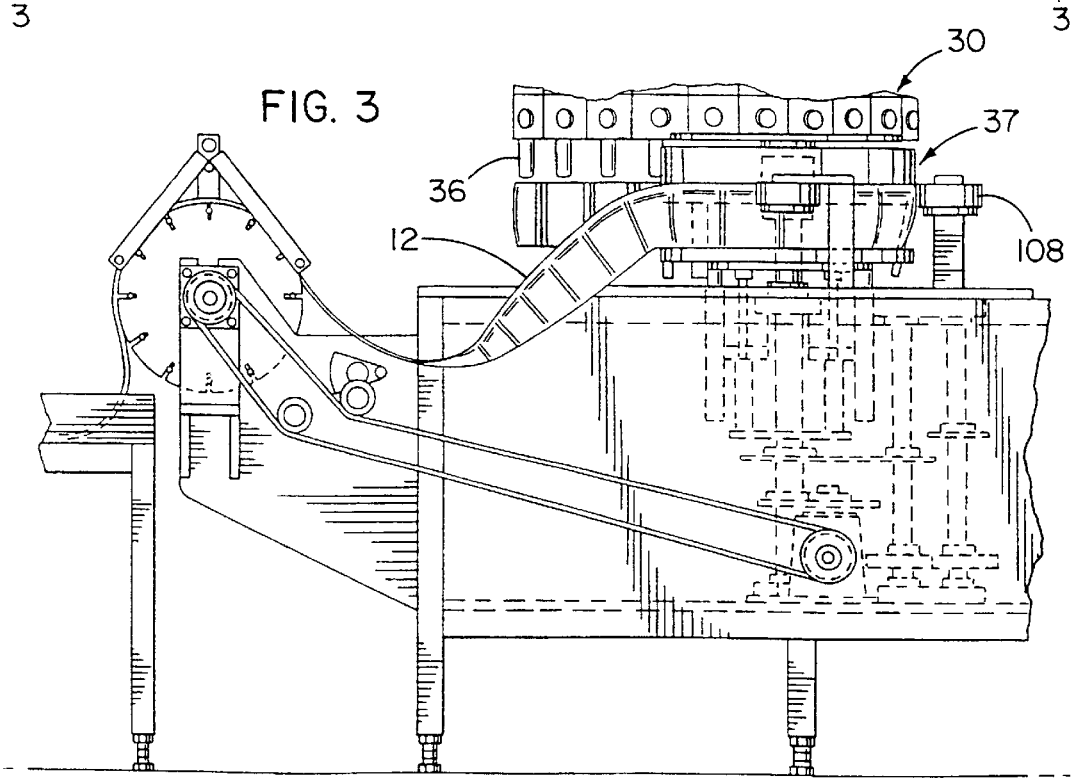
FIG. 3 is a side plan view of the present invention embodying important features of the present invention taken along line 3—3 of FIG. 2.

The newly formed horizontally disposed pouches 28 are now directed towards the filling station 30. The filling station comprises of a vacuum transfer wheel 32 positioned directly beneath a filler transfer wheel 34. As the pouches 28 enter the filling station 30, the pouches are opened by the vacuum transfer wheel 32 (FIG. 2) by separating the opposing sidewalls of each pouch. It is to be understood that the pouches 28 can be opened by a variety of different methods, including forcing air into the top edge of each pouch, as well as providing a vacuum suction on a central portion of the opposing sidewalls on each pouch to separate the sidewalls from each other.

Figure 15:
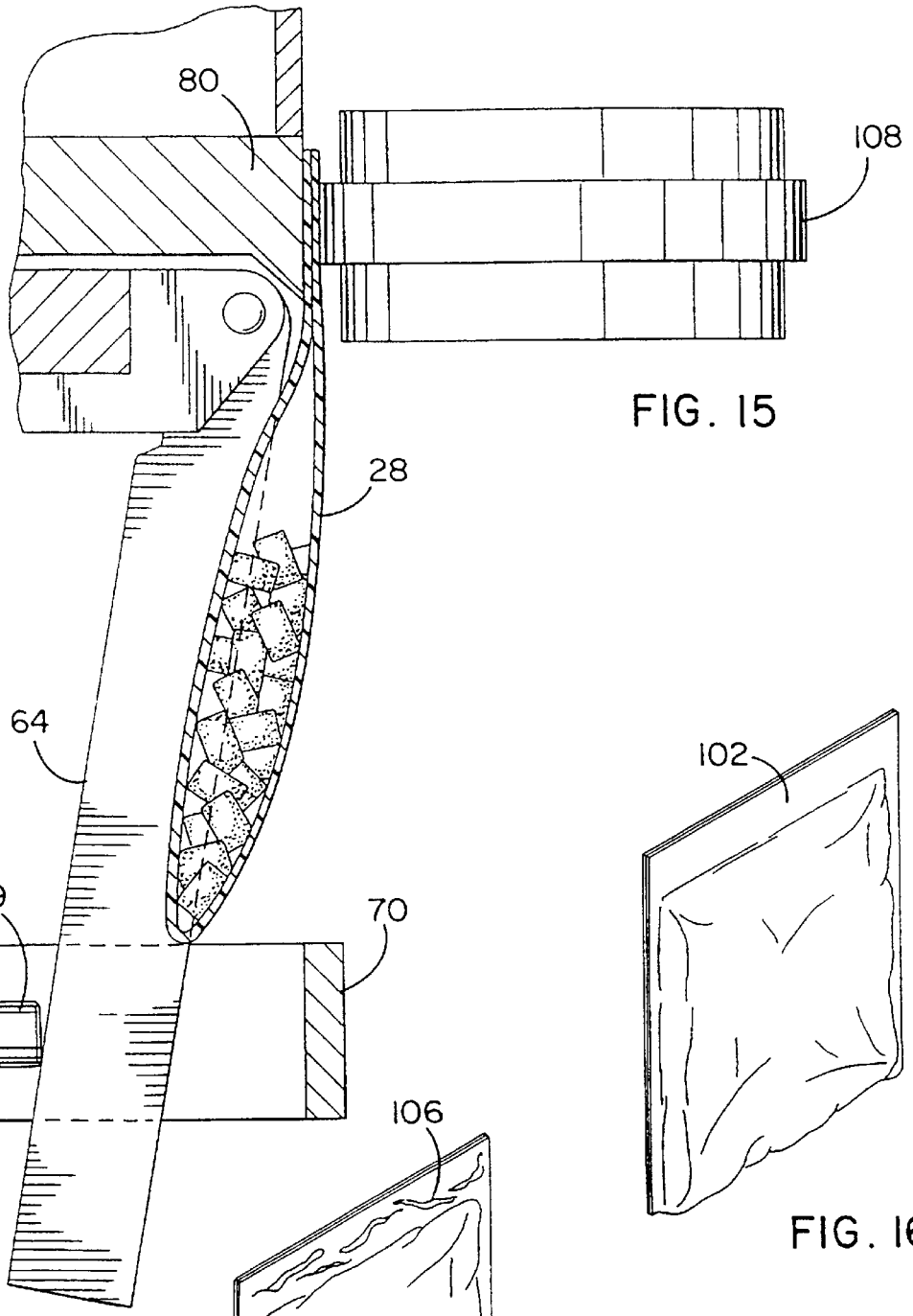
FIG. 15 is an enlarged partial cross-sectional side view illustrating how packages are sealed and rotated about the rotary top sealer of the present invention.

As the newly opened pouches 28 are rotated about the filling station 30, each of the pouches are then progressively filled from the filler transfer wheel 34 through filling spouts 36 positioned directly above a central portion of the opened pouches. In the present invention, the pouches 28 can be filled to a greater extent and allowing the pouches to take on a bulged shape or appearance, as shown in FIG. 15. It is to be understood that other types of filling methods can be employed with the features of the present invention.

Figure 6:
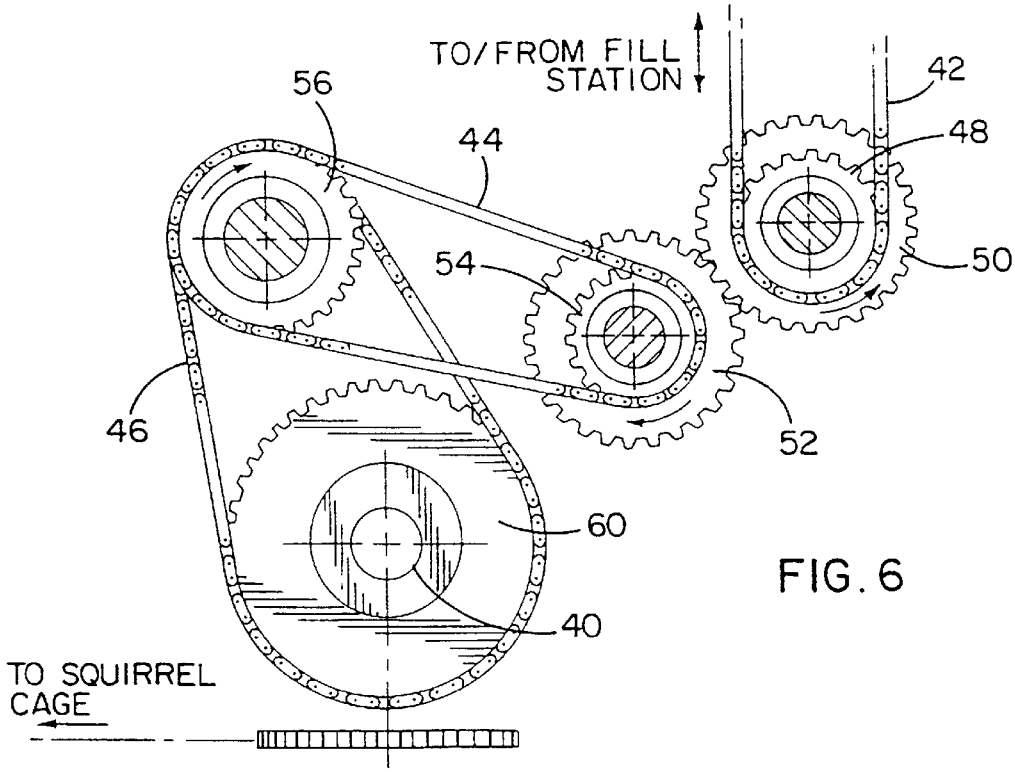
FIG. 6 is a fragmentary top plan view of the rotary top sealer gearing mechanism taken along line 6—6 of FIG. 5.
Figure 5:
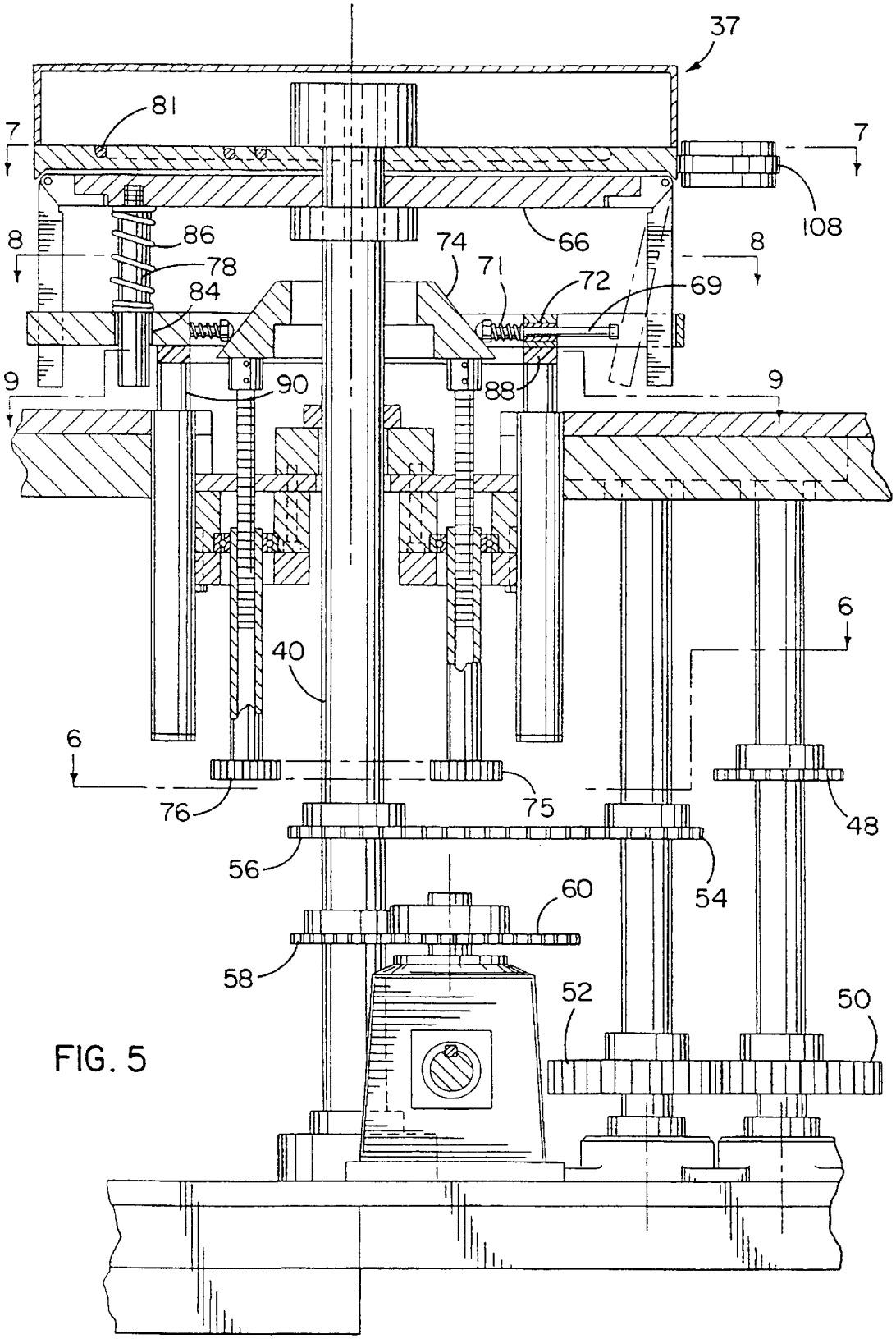
FIG. 5 is a fragmentary cross-sectional side plan view of the gearing mechanism used with the rotary top sealer taken along line 5—5 of FIG. 4.
Figure 7:
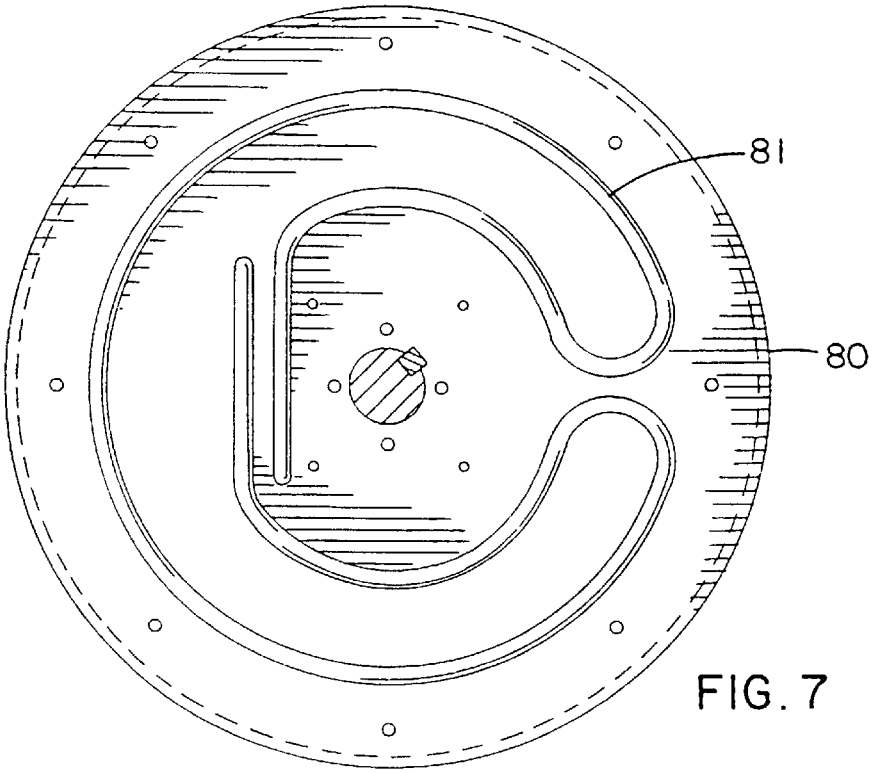
FIG. 7 is a fragmentary top plan view of the sealer plate and heating element of the rotary top sealer taken along line 7—7 of FIG. 5.
Figure 8:
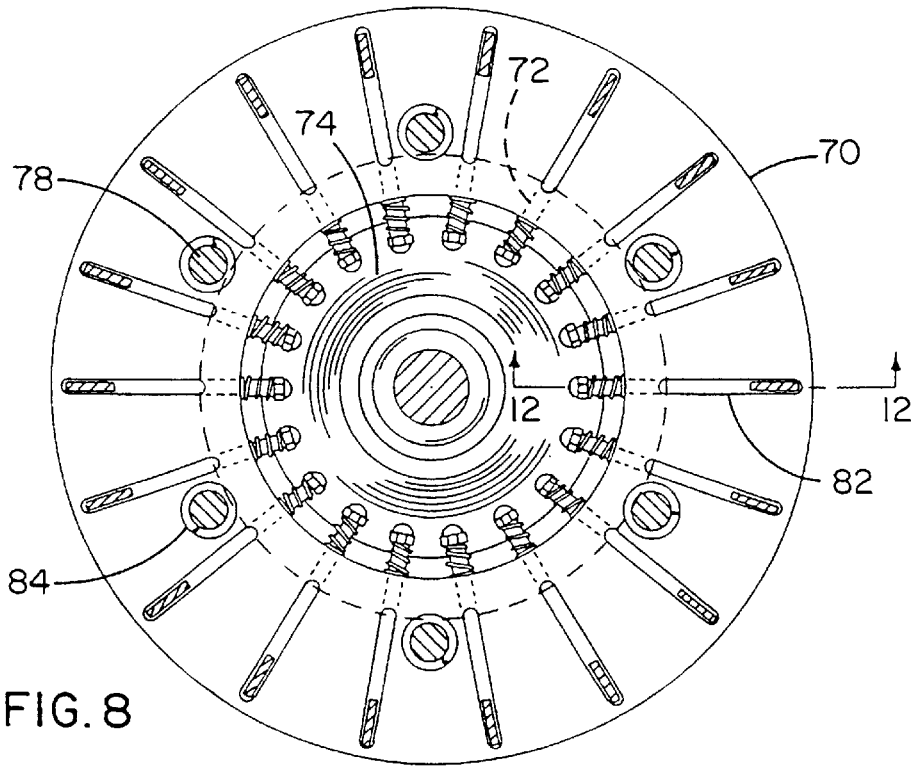
FIG. 8 is a fragmentary top plan view of the rotary top sealer as taken along line 8—8 of FIG. 5 embodying further important features of the present invention.
Figure 12:
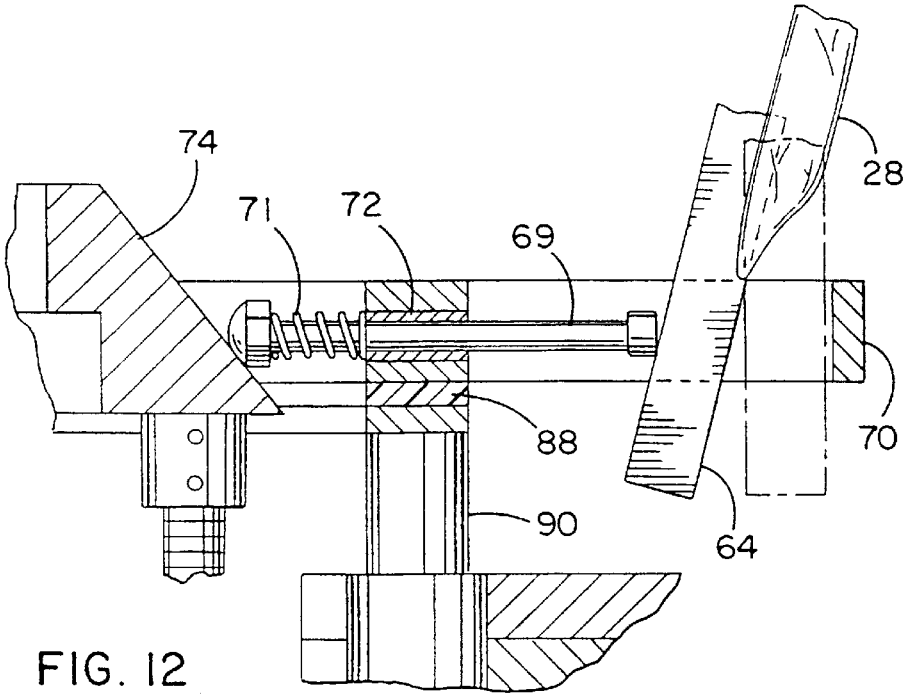
FIG. 12 is an enlarged partial cross-sectional side view taken along line 12—12 of FIG. 8 illustrating the land stops of the rotary top sealer.
Figure 13:
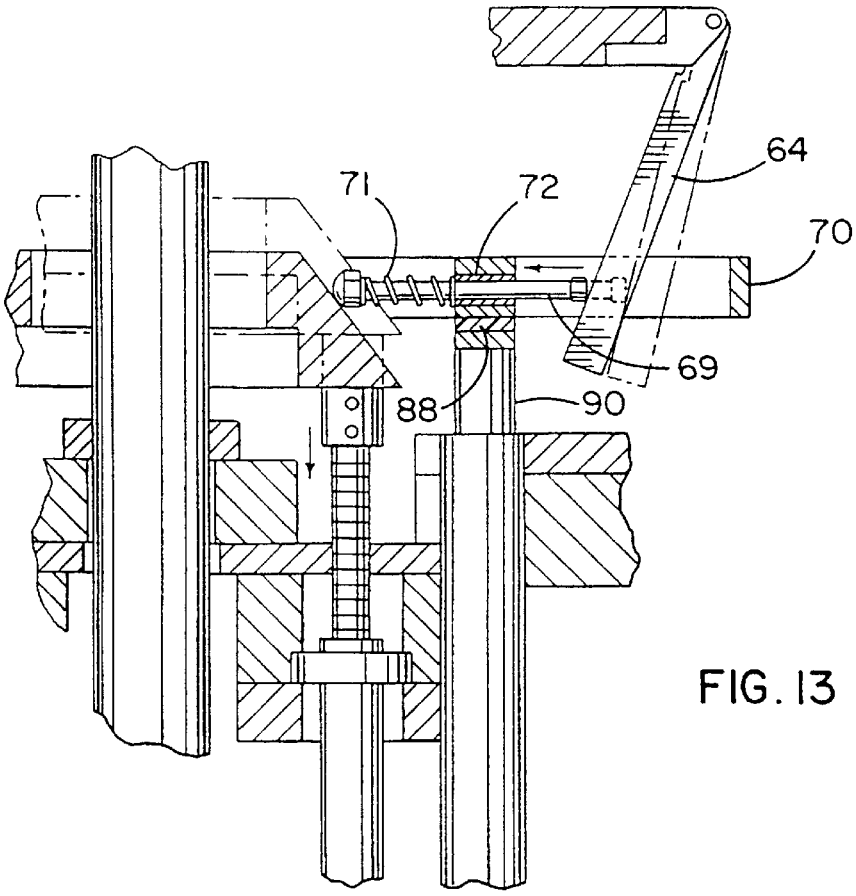
FIG. 13 is an enlarged partial cross-sectional side view illustrating how the land stops of the rotary top sealer can be adjusted.
Figure 14:
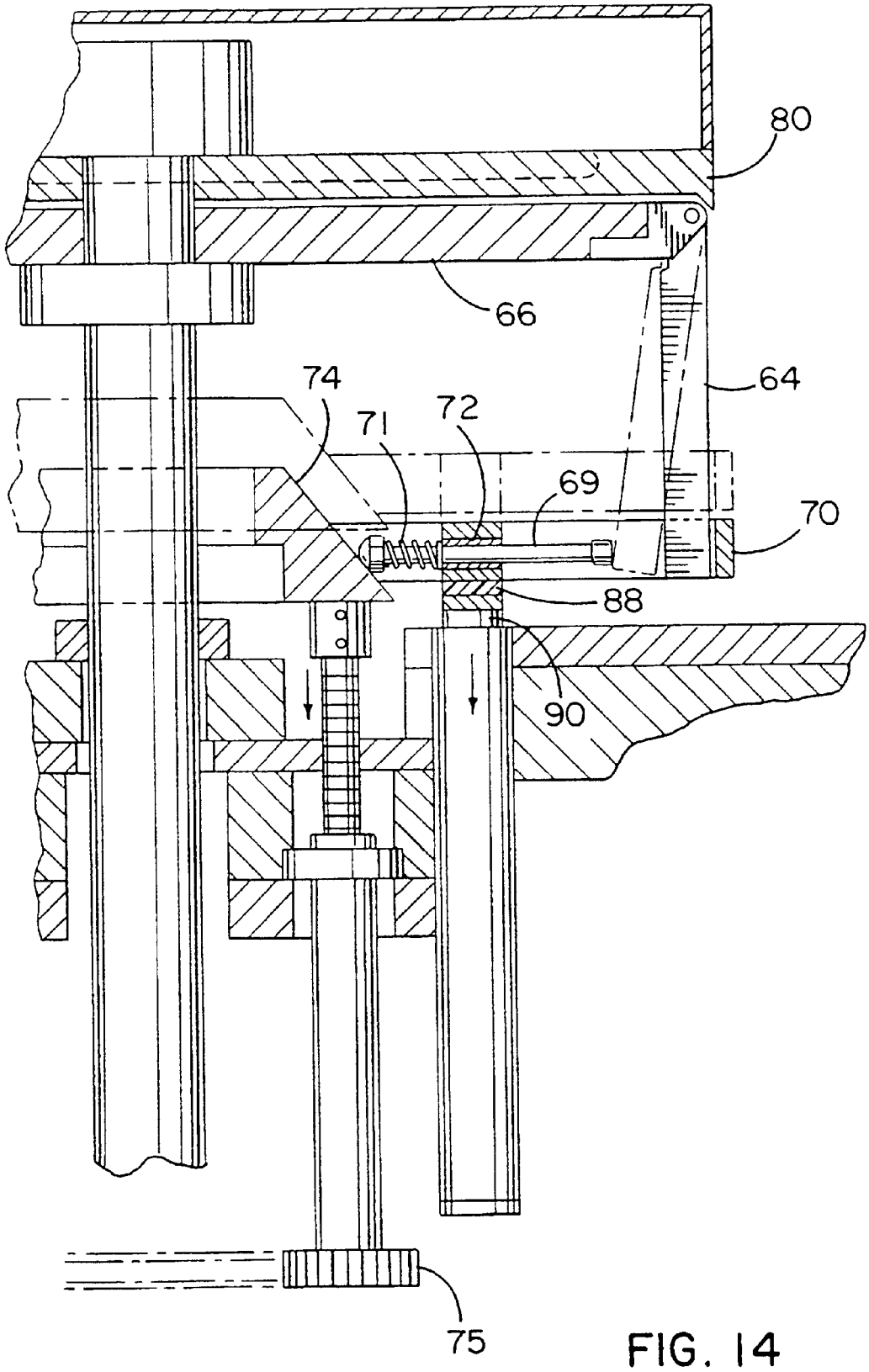
FIG. 14 is an enlarged partial cross-sectional side view illustrating how the height of the bottom plate can be adjusted to accommodate packages of different heights.

After each pouch 28 has been filled, the web 14 is then immediately directed around a horizontal rotary top sealer 37. The rotary top sealer 37 can be positioned adjacent to the filling station 30 and can be directly tied mechanically to the filling station gearing mechanism in order to have consistently aligned rotating units. As can be seen in FIGS. 5 and 6, the filler transfer wheel is timed to work with the rotary top sealer shaft 40 through a series of chains 42, 44, 46, and gears and sprockets 48, 50, 52, 54, 56, 58, 60. As is illustrated in FIG. 6, the chains, gears and sprockets provide a reverse rotation of the rotary top sealer relative to the filling station. The filling station chain 42 is connected from the filling station 30, and through a series of chains and gears, powers the rotary top sealer shaft 40. This gearing mechanisms enables the filled packages to smoothly transfer from the filling station 30 to the rotary top sealer 37. Various different motors and other different methods and designs can be employed to power the devices of the present invention and are not the subject of the invention herein disclosed.

Figure 4:
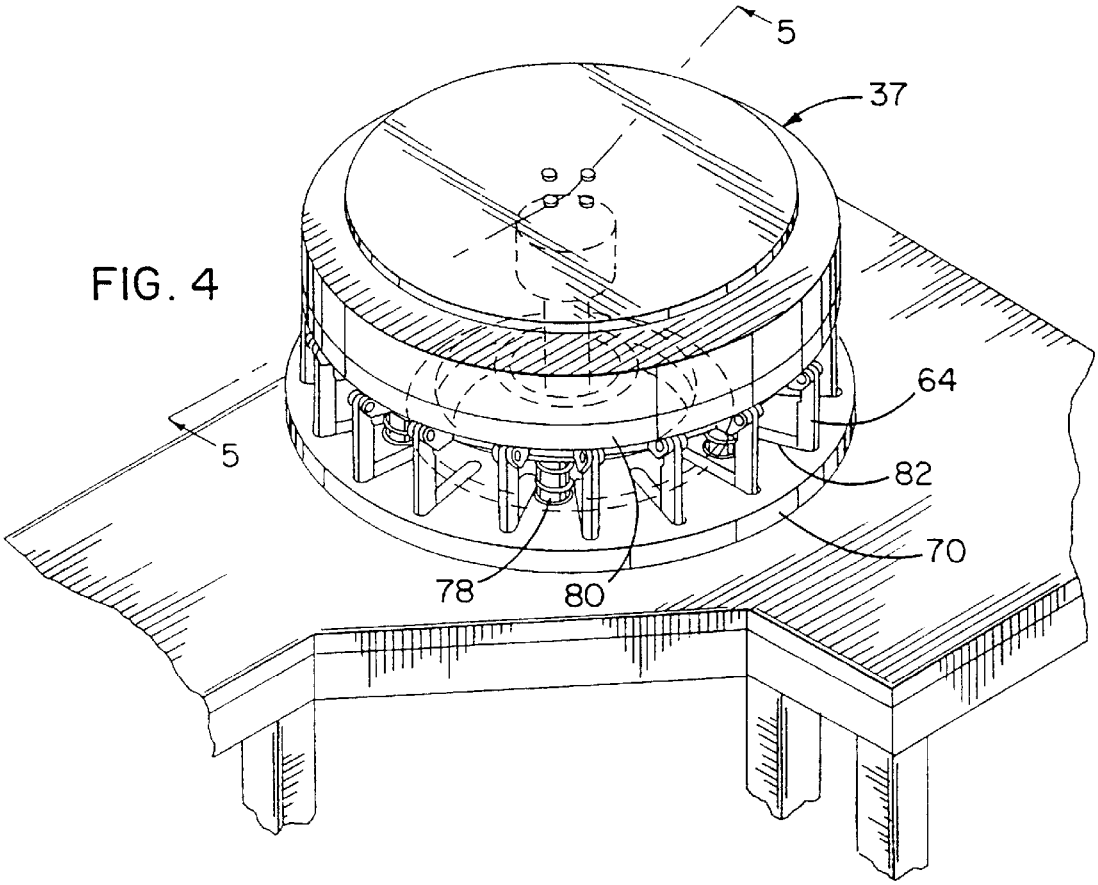
FIG. 4 is a fragmentary perspective view of the rotary top sealer of the present invention.

Excellent results can be obtained when the rotary top sealer 37 is located as close to the filling station 30 as possible in order to minimize the length of unsupported web between the two units. The lands 64 (FIG. 4) of the rotary top sealer 37 are in phase with the lands 65 (FIG. 2) on the vacuum transfer wheel. This provides a smooth transition of the web to the rotary top sealer 37. Since the lands 64 of the rotary top sealer only contact the vertical seal of the pouch product, disturbance within the pouch 28 is minimized.

Each of the lands 64 has a relatively rectangular shape and has a thickness less than a thickness of the vertical seals on the series of horizontally disposed pouches 28. A land plate 66 is positioned directly below the heated circular sealer plate 80. The land plate 66 has a diameter smaller than the heated circular sealer plate and is mounted in corresponding rotation with the sealer plate 80. Each of the lands 64 are pivotally mounted with a mounting bracket 67 and a pivot pin 68 at an upper end along the outer edge of the land plate 66 allowing each of the lands to freely pivot radially inward and extend vertically downward. The plurality of lands are equally spaced about the circumference of the land plate wherein the distance between each land is equivalent to the distance between the vertical seals on the series of horizontally disposed adjoining pouches 28, whereby when the horizontally disposed adjoining pouches are trained onto the horizontal rotary sealer to join and seal the upper portion of the adjoining pouches, the vertical seals extending below the top edge of the pouches will engage with the lands 64 and curve radially inward in engagement with the lands, thereby helping to keep the horizontally disposed adjoining pouches properly aligned.

As can be seen in FIGS. 5, 12, 13, 14, and 15, the rotary top sealer lands 64 are allowed to pivot inward until they rest against a land stop 69. Land stop settings are adjustable in order to accommodate different pouch fills. The land stops 69 are mounted in a bottom plate 70 and are allowed to slide through a bearing 72 in an inward radial direction.

The land stops 69 are spring loaded with coiled springs 71 inwardly against a non-rotating fixed cone 74. The vertical height of the cone 74 can be changed (FIGS. 5, 14) while the rotary top sealer 37 is running through the use of two screw assemblies 75, 76. This then allows uniform adjustment of the inward pivot movement of the lands.

Six posts 78 which are mounted to the sealer plate 80 provide the mounting for a bottom plate 70. The bottom plate 70 has a diameter similar to the sealer plate 80 and contains clearance slots 82 for the lands and holes with bushings 84 for the posts 78 to slip through. This allows the bottom plate to have a corresponding equivalent rotation with the sealer plate 80. Springs 86 are fitted over the posts 78 and hold the bottom plate 70 against the wear plate 88. The wear plate 88 is mounted to four hydraulic cylinders 90 which provide dynamic adjustment. This adjustment allows the bottom plate to move up and down and is necessary for package height and package fill changes. For clarity purposes, FIGS. 5 and 14 do not show all of the posts and lands extending around the rotary top sealer 37.

Figure 16:
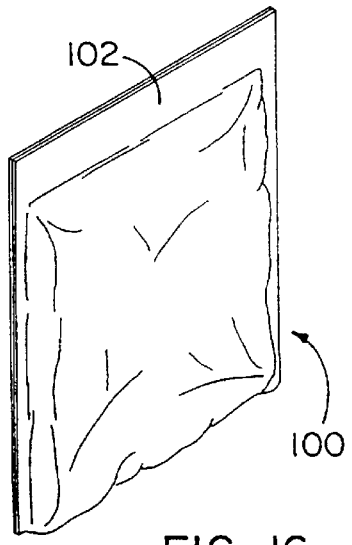
FIG. 16 is a perspective view of a sealed package using the rotary top sealer of the present invention.
Figure 17:
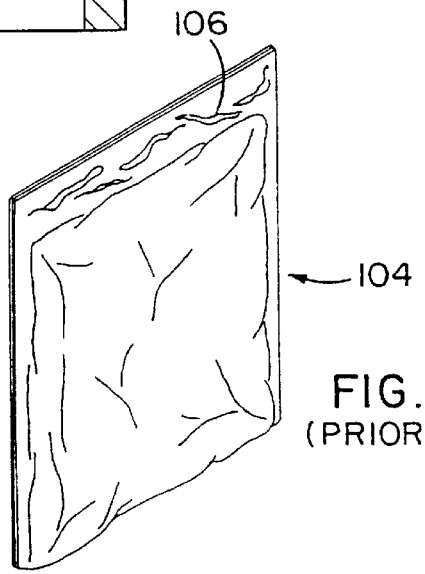
FIG. 17 (PRIOR ART)
FIG. 17 is a perspective view of a sealed package utilizing the prior art of sealing top edges of packages.

The sealer plate 80 contains a heating element 81 to heat the sealer plate, particularly the outer edge, and is designed to be slightly larger than the land plate 66 to help iron out wrinkles in the packages 28 that are being sealed, thereby providing a smooth top seal. Since the smooth top seal is created by training the upper edge of the pouches along a circular sealer wherein the top edge is progressively stretched and closed, the packages can then accommodate a greater amount of product fill than prior top sealing devices. This sealing method provides for a filled package 100 (FIG. 16) that has a smooth hermetic top seal 102. Using the same amount of package filling, the prior art sealing methods does not consistently provide a uniform hermetic seal as is shown in the package 104 and seal 106 in FIG. 17. The lands 64 and the bottom plate 70 help keep large pouches with a heavier product fill properly aligned and supported as the top seal is created. Smaller packages with a light fill may not require the use of lands or the bottom plate. As long as there is a sufficient tension in the web of pouches traveling around the top sealer, lighter and smaller packages may not require the support provided by the lands and the bottom plate. However, the use of a circular sealer enables the packages to contain a greater amount of fill then prior sealing devices allow.

As the web of pouches is trained onto the horizontal rotary top sealer 37, the heated sealer plate 80 progressively forms a continuous horizontal seal as the top edge of each pouch is continuously moved radially and circumferentially about the outer edge of the heated circular sealer plate 80. The heated circular sealer plate 80 provides an adequate temperature to provide a sealing action to the top edge of each pouch contacting the sealer plate and smoothly seals and encloses the filled pouches.

Depending on the size of the packages used and the amount of fill placed within the packages, backup rollers or press rollers 108 may need to be used to provide pressure against the upper edge of the web of pouches 28 and the sealer plate 80. The backup rollers are mounted for counter-rotation pressing engagement against the rotating circumference of the heated circular sealer plate 80 in order to pinch and seal the top edge of the pouches. Excellent results are obtained when using a backup roller with larger packages containing a heavier fill. Smaller packages with a light powder fill may not require the use of backup rollers to create a uniform top seal, and wherein the web of packages has a sufficient tension to create a proper seal.

In the design of the presently disclosed invention, the web of pouches 28 exits the rotary top sealer unit 37 180 degrees from the entering point. It is not essential for the web of pouches to travel a full 180 degrees around the rotary top sealer, but it is necessary for the upper edge of film material to be in contact with the sealer plate for a predetermined amount of time over a portion of the sealer plate in order to provide an adequate seal. Excellent results can be obtained when a film/film structure such as PET-polyethylene material is in contact with the sealer plate having a temperature between 400–410 degrees for approximately one (1) second. Other types of fusible film materials may require more or less time to adequately seal the packages and appropriate adjustments regarding the temperature of the sealer plate and the speed of rotation can be made.

After the top seal has been created, the web of sealed packages then continues onto a cutter that separates the packages from the continuous web, wherein the packages are then ultimately boxed for distribution.

Although the invention has been described by reference to some embodiments, it is not intended that the novel device be limited thereby, but that modifications thereof are intended to be included as falling within the broad scope and spirit of the foregoing disclosure, the following claims and the appended drawings.

We claim:

1. A method of continuously forming, filling and sealing of packages with a continuous web of film material, comprising the steps of:

a) providing a continuous web of film material;

b) folding the web to provide confronting sides joined along a bottom edge;

c) forming a vertical seal at spaced intervals along the web thereby providing a series of horizontally disposed adjoining pouches having opposed sidewalls with each pouch unsealed along a top edge;

d) opening the pouches by separating the opposed sidewalls;

e) filling the pouches with a material; and f) sealing the top edge of each pouch together to close the filled pouches by training the pouches onto a horizontal rotary sealer having a heated circular sealer plate and progressively forming a continuous horizontal seal as the top edge of each pouch is being continuously moved along with a circumference of the heated circular sealer plate while at the same time applying an adequate temperature to provide a sealing action and allowing the top edge of each pouch to be joined together and smoothly sealed to enclose the filled pouches, said horizontal rotary sealer having means to provide a vertical support to said continuous web of film material such that said means to provide a vertical support to said continuous web of film material contacts only said vertical seal of said pouch without contacting confronting sides of said filled pouch so that disturbance of the material within said pouch is minimized as the top edge is sealed.

2. The method of claim 1, further comprising the step of supporting a bottom portion of each pouch while sealing the top edge, wherein the horizontal rotary sealer further includes a bottom plate, the bottom plate being mounted in corresponding rotation with the heated circular sealer plate and is positioned a predetermined distance below the heated circular sealer plate to allow the bottom portion of the horizontally disposed adjoining pouches to rest thereon.

3. The method of claim 2, wherein the position of the bottom plate is adjustable at varying heights to accommodate pouches of different heights.

4. The method of claim 1, further comprising the step of keeping the web of horizontally disposed adjoining pouches properly aligned while sealing the top edge, wherein the horizontal rotary sealer further includes a land plate and a plurality of lands, the land plate having a diameter slightly smaller than the heated circular sealer plate and being positioned directly below the heated circular sealer plate, the land plate being mounted in corresponding rotation with the circular sealer plate, each of the lands having a relatively rectangular shape and having a thickness less than a thickness of the vertical seals on the series of horizontally disposed adjoining pouches, the plurality of lands being pivotally mounted at an upper end along the outer edge of the land plate allowing each of the lands to freely pivot radially inward and extend vertically downward from the land plate, the plurality of lands being equally spaced about the circumference of the land plate wherein the distance between each land is equivalent to the distance between the vertical seals on the series of horizontally disposed adjoining pouches, whereby when the horizontally disposed adjoining pouches are trained onto the horizontal rotary sealer to join and seal the upper portion of the adjoining pouches, the vertical seals extending below the top edge of the pouches will engage with the lands and curve radially inward in engagement with the lands, thereby helping to keep the horizontally disposed adjoining pouches properly aligned.

5. The method of claim 4, wherein the horizontal rotary sealer further includes a land stop means, the land stop means acting to stop each of the lands from pivoting radially inward beyond a predetermined distance.

6. The method of claim 1, further comprising the step of training the web of horizontally disposed adjoining pouches about a portion of the circumference of the horizontal rotary sealer while sealing the top edge.

7. The method of claim 1, wherein the horizontal rotary sealer further includes at least one press roller mounted for counter-rotation in pressing engagement against the rotating circumference of the heated circular sealer plate in order to help seal and align the top edge of the web of horizontally disposed pouches.

8. A method of forming a horizontal top seal for use in a packaging machine having a continuous web of film material having a series of horizontally disposed filled pouches separated by vertical seals extending transversely of the web and having opposed sidewalls of each pouch unsealed along a top edge, the method comprising training the horizontally disposed filled pouches onto a horizontal rotary sealer, having a heated circular sealer plate and progressively forming a continuous horizontal seal as the top edge of each pouch is being continuously moved along with a circumference of the heated circular sealer plate while at the same time applying an adequate temperature to provide a sealing action and allowing the top edge of each pouch to be gently joined together and smoothly sealed to enclose the filled pouches, said horizontal rotary sealer having means to provide a vertical support to said continuous web of film material such that said means to provide a vertical support to said continuous web of film material contacts only said vertical seal of said pouch without contacting said opposed sidewalls of said filled pouch so that disturbance of the material within said pouch is minimized as the top edge is sealed.

9. The method of claim 8, further comprising the step of supporting a bottom portion of each pouch while sealing the top edge, wherein the horizontal rotary sealer further includes a bottom plate, the bottom plate being mounted in corresponding rotation with the heated circular sealer plate and is positioned a predetermined distance below the heated circular sealer plate to allow the bottom portion of the horizontally disposed filled pouches to rest thereon.

10. The method of claim 9, wherein the position of the bottom plate is adjustable at varying heights to accommodate pouches of different heights.

11. The method of claim 8, further comprising the step of keeping the web of horizontally disposed filled pouches properly aligned while sealing the top edge, wherein the horizontal rotary sealer further includes a land plate and a plurality of lands, the land plate having a diameter slightly smaller than the heated circular sealer plate and being positioned directly below the heated circular sealer plate, the land plate being mounted in corresponding rotation with the circular sealer plate, each of the lands having a relatively rectangular shape and having a thickness less than a thickness of the vertical seals on the series of horizontally disposed adjoining pouches, the plurality of lands being pivotally mounted at an upper end along the outer edge of the land plate allowing each of the lands to freely pivot radially inward and extend vertically downward from the land plate, the plurality of lands being equally spaced about the circumference of the land plate wherein the distance between each land is equivalent to the distance between the vertical seals on the series of horizontally disposed filled pouches, whereby when the horizontally disposed filled pouches are trained onto the horizontal rotary sealer to join and seal the upper portion of the filled pouches, the vertical seals extending below the top edge of the pouches will engage with the lands and curve radially inward in engagement with the lands, thereby helping to keep the horizontally disposed filled pouches properly aligned.

12. The method of claim 11, wherein the horizontal rotary sealer further includes a land stop means, the land stop means acting to stop each of the lands from pivoting radially inward beyond a predetermined distance.

13. The method of claim 8, further comprising the step of training the web of horizontally filled pouches about a portion of the circumference of the horizontal rotary sealer while sealing the top edge.

14. The method of claim 8, wherein the horizontal rotary sealer further includes at least one press roller mounted for counter-rotation in pressing engagement against the rotating circumference of the heated circular sealer plate in order to help seal and align the top edge of the web of horizontally disposed filled pouches.

15. A packaging apparatus, comprising:

a) means for feeding a continuous web of film material having confronting sides;

b) means for forming vertical seals in the web to form a series of horizontally disposed pouches separated by the vertical seals, the vertical seals extending transversely of the web from a bottom edge of the pouch to an upper portion of the pouch;

c) means for opening the pouches by separating opposed sidewalls of the pouches;

d) means for filling the pouches with a material to form outwardly bulged sidewalls; and e) a horizontal rotary seal former having a heated circular sealer plate mounted for rotation, the heated circular sealer plate having a flat outer surface positioned about its circumference for engagement with an upper portion of the pouches for progressively forming a continuous horizontal seal as the web is being continuously moved along with the circumference of the heated circular sealer plate while at the same time applying an adequate temperature to provide a sealing action and allowing the upper portion of the pouches to be joined together and smoothly sealed, said horizontal rotary sealer having means to provide a vertical support to said continuous web of film material such that said means to provide a vertical support to said continuous web of film material contacts only said vertical seal of said pouch without contacting said confronting sides of said filled pouch so that disturbance of the material within said vouch is minimized as the top edge is sealed.

16. The packaging apparatus of claim 15, wherein the horizontal rotary seal former further includes a land plate and a plurality of lands, said land plate being positioned directly below the heated circular sealer plate, said land plate being mounted in corresponding rotation with the heated circular sealer plate, each of said lands having a relatively rectangular shape and having a thickness less than a thickness of the vertical seals on the series of horizontally disposed pouches, said plurality of lands being pivotally mounted at an upper end along the outer edge of the land plate allowing each of said lands to freely pivot radially inward and extend vertically downward from the land plate, said plurality of lands being equally spaced about the circumference of the land plate wherein the distance between each land is equivalent to the distance between the vertical seals on the series of horizontally disposed filled pouches, whereby when the web of horizontally disposed pouches are trained onto the horizontal seal former to join and seal the upper portion of the pouches, the vertical seals extending below the upper edge of the filled pouches will engage with the lands and curve radially inward in engagement with the lands, thereby helping to keep the horizontally disposed pouches properly aligned.

17. The packaging apparatus of claim 16, wherein the horizontal rotary seal former further includes a land stop means, said land stop means acting to stop each of the lands from pivoting radially inward beyond a predetermined distance.

18. The packaging apparatus of claim 16, wherein the horizontal rotary seal former further includes a bottom plate, said bottom plate having a diameter equivalent to the heated circular sealer plate and is mounted in corresponding rotation with the heated circular sealer plate, said bottom plate being positioned a predetermined distance below the heated circular sealer plate to allow the bottom edge of the horizontally disposed pouches to rest thereon.

19. The packaging apparatus of claim 18, wherein the position of the bottom plate in the horizontal rotary seal former is adjustable at varying heights to accommodate pouches of varying lengths.

20. The packaging apparatus of claim 15, wherein the horizontal rotary seal former further includes a bottom plate, said bottom plate having a diameter equivalent to the heated circular sealer plate and is mounted in corresponding rotation with the heated circular sealer plate, said bottom plate being positioned a predetermined distance below the heated circular sealer plate to allow the bottom edge of the horizontally disposed pouches to rest thereon.

21. The packaging apparatus of claim 15, further comprising at least one press roller mounted for counter-rotation in pressing engagement against the rotating circumference of the flat outer surface of the heated circular sealer plate in order to help seal and align the upper portion of the web of horizontally disposed pouches.

22. A horizontal seal former device for use with a continuous web of film material having confronting sides and a series of horizontally disposed filled pouches defined by a series of vertical seals extending transversely of the web from a bottom edge of the pouch to an upper portion of the pouch, the device comprising: a top seal shaft, said top seal shaft being connected to a rotating means for rotating said top seal shaft, a heated circular sealer plate mounted for rotation on said top seal shaft, said circular sealer plate having a flat outer surface positioned about its circumference for engagement with an upper portion of a continuous web of filled pouches for progressively forming a continuous horizontal seal as the web is moved along with the rotating circumference of the flat outer surface while at the same time applying an adequate temperature to provide a sealing action and allowing the upper portion of the pouches to be joined together and smoothly sealed to enclose the filled pouches, said circular sealer plate further having means to provide a vertical support to said continuous web of film material such that said means to provide a vertical support to said continuous web of film material contacts only said vertical seal of said pouch without contacting said confronting sides of said filled pouch so that disturbance of the material within said pouch is minimized as the top edge is sealed.

23. The horizontal seal former device of claim 22, further including a land plate and a plurality of lands, said land plate being positioned directly below the heated circular sealer plate and is mounted in corresponding rotation with the circular sealer plate, each of said lands having a relatively rectangular shape and having a thickness less than a thickness of the vertical seals on the series of horizontally disposed filled pouches, said plurality of lands being pivotally mounted at an upper end along the outer edge of the land plate allowing each of said lands to freely pivot radially inward and extend vertically downward from the land plate, said plurality of lands being equally spaced about the circumference of the land plate wherein the distance between each land is equivalent to the distance between the vertical seals on the series of horizontally disposed filled pouches, whereby when the horizontally disposed filled pouches are trained onto the horizontal seal former to join and seal the upper portion of the filled pouches, the vertical seals extending below the upper edge of the filled pouches will engage with the lands and curve radially inward in engagement with the lands, thereby helping to keep the horizontally disposed filled pouches properly aligned.

24. The horizontal seal former device of claim 23, further including a land stop means, said land stop means acting to stop each of the lands from pivoting radially inward beyond a predetermined distance.

25. The horizontal seal former device of claim 23, further including a bottom plate, said bottom plate having a diameter equivalent to the heated circular sealer plate and is mounted in corresponding rotation with the heated circular sealer plate, said bottom plate being positioned a predetermined distance below the heated circular sealer plate to allow the bottom edge of the horizontally disposed filled pouches to rest thereon.

26. The horizontal seal former device of claim 25, wherein the position of the bottom plate is adjustable at varying heights to accommodate pouches of varying lengths.

27. The horizontal seal former device of claim 22, further including a bottom plate, said bottom plate having a diameter equivalent to the heated circular sealer plate and is mounted in corresponding rotation with the heated circular sealer plate, said bottom plate being positioned a predetermined distance below the heated circular sealer plate to allow the bottom edge of the horizontally disposed filled pouches to rest thereon.

28. The horizontal seal former device of claim 22, further comprising at least one press roller mounted for counter-rotation in pressing engagement against the rotating circumference of the flat outer surface of the heated circular sealer plate in order to help seal and align the upper portion of the web of horizontally disposed filled pouches.

29. A method of continuously forming, filling and sealing of packages with a continuous web of film material, comprising the steps of:

a) providing a continuous web of film material;

b) folding the web to provide confronting sides joined along a bottom edge;

c) forming a vertical seal at spaced intervals along the web thereby providing a series of horizontally disposed adjoining pouches having opposed sidewalls with each pouch unsealed along a top edge;

d) opening the pouches by separating the opposed sidewalls;

e) filling the pouches with a material to form outwardly bulged sidewalls; and f) radially and circumferentially moving the open filled pouches in union with a circumferentially moving heated circular sealer plate while at the same time applying an adequate temperature to provide a sealing action and allowing the top edges of each pouch to be joined together and smoothly sealed to enclose the filled pouches, said moving heated circular sealer plate having means to provide a vertical support to said continuous web of film material such that said means to provide a vertical support to said continuous web of film material contacts only said vertical seal of said pouch without contacting said outwardly bulged sidewalls of said filled pouch so that disturbance of the material within said pouch is minimized as the top edge is sealed.

30. The method of claim 29, further comprising the step of supporting a bottom portion of each pouch while moving the open filled pouches in union with the circumferentially moving heated circular sealer plate, wherein the heated circular sealer plate further includes a bottom plate, the bottom plate being mounted in corresponding rotation with the heated circular sealer plate and is positioned a predetermined distance below the heated circular sealer plate to allow the bottom portion of the horizontally disposed adjoining pouches to rest thereon.

31. The method of claim 30, wherein the position of the bottom plate is adjustable at varying heights to accommodate pouches of different heights.

32. The method of claim 29, further comprising the step of keeping the web of horizontally disposed adjoining pouches properly aligned while moving the open filled pouches in union with the circumferentially moving heated circular sealer plate, wherein the heated circular sealer plate further includes a land plate and a plurality of lands, the land plate having a diameter smaller than the heated circular sealer plate and being positioned directly below the heated circular sealer plate, the land plate being mounted in corresponding rotation with the circular sealer plate, each of the lands having a relatively rectangular shape and having a thickness less than a thickness of the vertical seals on the series of horizontally disposed adjoining pouches, the plurality of lands being pivotally mounted at an upper end along the outer edge of the land plate allowing each of the lands to freely pivot radially inward and extend vertically downward from the land plate, the plurality of lands being equally spaced about the circumference of the land plate wherein the distance between each land is equivalent to the distance between the vertical seals on the series of horizontally disposed adjoining pouches, whereby when the horizontally disposed adjoining pouches are trained onto the heated circular sealer plate to join and seal the upper portion of the adjoining pouches, the vertical seals extending below the top edge of the pouches will engage with the lands and curve radially inward in engagement with the lands, thereby helping to keep the horizontally disposed adjoining pouches properly aligned.

33. The method of claim 32, wherein the heated circular sealer plate further includes a land stop means, the land stop means acting to stop each of the lands from pivoting radially inward beyond a predetermined distance.

34. The method of claim 29, further comprising the step of training the web of horizontally disposed adjoining pouches about a portion of the circumference of the heated circular sealer plate while sealing the top edge.

35. The method of claim 29, wherein the heated circular sealer plate further includes at least one press roller mounted for counter-rotation in pressing engagement against the rotating circumference of the heated circular sealer plate in order to help seal and align the top edge of the web of horizontally disposed pouches.

36. A method of continuously forming, filling and sealing of packages with a continuous web of film material, comprising the steps of:

a) providing a continuous web of film material;

b) folding the web to provide confronting sides joined along a bottom edge;

c) forming a vertical seal at spaced intervals along the web thereby providing a series of horizontally disposed adjoining pouches having opposed sidewalls with each pouch unsealed along a top edge;

d) opening the pouches by separating the opposed sidewalls;

e) filling the pouches with a material; and f) sealing the top edge of each pouch together to close the filled pouches by training the pouches onto a horizontal rotary sealer having a heated circular sealer plate and progressively forming a continuous horizontal seal as the top edge of each pouch is being continuously moved along with a circumference of the heated circular sealer plate while at the same time applying an adequate temperature to provide a sealing action and allowing the top edge of each pouch to be joined together and smoothly sealed to enclose the filled pouches, and maintaining the web of horizontally disposed adjoining pouches properly aligned while sealing the top edge, wherein the horizontal rotary sealer further includes a land plate and a plurality of lands, the land plate having a diameter slightly smaller than the heated circular sealer plate and being positioned directly below the heated circular sealer plate, the land plate being mounted in corresponding rotation with the circular sealer plate, each of the lands having a relatively rectangular shape and having a thickness less than a thickness of the vertical seals on the series of horizontally disposed adjoining pouches, the plurality of lands being pivotally mounted at an upper end along the outer edge of the land plate allowing each of the lands to freely pivot radially inward and extend vertically downward from the land plate, the plurality of lands being equally spaced about the circumference of the land plate wherein the distance between each land is equivalent to the distance between the vertical seals on the series of horizontally disposed adjoining pouches, whereby when the horizontally disposed adjoining pouches are trained onto the horizontal rotary sealer to join and seal the upper portion of the adjoining pouches, the vertical seals extending below the top edge of the pouches will engage with the lands and curve radially inward in engagement with the lands, thereby helping to keep the horizontally disposed adjoining pouches properly aligned.

37. The method of claim 36, wherein the horizontal rotary sealer further includes a land stop means, the land stop means acting to stop each of the lands from pivoting radially inward beyond a predetermined distance.

38. A packaging apparatus, comprising:

a) means for feeding a continuous web of film material having confronting sides;

b) means for forming vertical seals in the web to form a series of horizontally disposed pouches separated by the vertical seals, the vertical seals extending transversely of the web from a bottom edge of the pouch to an upper portion of the pouch;

c) means for opening the pouches by separating opposed sidewalls of the pouches;

d) means for filling the pouches with a material; and e) a horizontal rotary seal former having a heated circular sealer plate mounted for rotation, the heated circular sealer plate having a flat outer surface positioned about its circumference for engagement with an upper portion of the pouches for progressively forming a continuous horizontal seal as the web is being continuously moved along with the circumference of the heated circular sealer plate while at the same time applying an adequate temperature to provide a sealing action and allowing the upper portion of the pouches to be joined together and smoothly sealed, the horizontal rotary seal former having a land plate and a plurality of lands, said land plate being positioned directly below the heated circular sealer plate, said land plate being mounted in corresponding rotation with the heated circular sealer plate, each of said lands having a relatively rectangular shape and having a thickness less than a thickness of the vertical seals on the series of horizontally disposed pouches, said plurality of lands being pivotally mounted at an upper end along the outer edge of the land plate allowing each of said lands to freely pivot radially inward and extend vertically downward from the land plate, said plurality of lands being equally spaced about the circumference of the land plate wherein the distance between each land is equivalent to the distance between the vertical seals on the series of horizontally disposed filled pouches, whereby when the web of horizontally disposed pouches are trained onto the horizontal seal former to join and seal the upper portion of the pouches, the vertical seals extending below the upper edge of the filled pouches will engage with the lands and curve radially inward in engagement with the lands, thereby helping to keep the horizontally disposed pouches properly aligned.

39. The packaging apparatus of claim 38, wherein the horizontal rotary seal former further includes a land stop means, said land stop means acting to stop each of the lands from pivoting radially inward beyond a predetermined distance.

40. The packaging apparatus of claim 38, wherein the horizontal rotary seal former further includes a bottom plate, said bottom plate having a diameter equivalent to the heated circular sealer plate and is mounted in corresponding rotation with the heated circular sealer plate, said bottom plate being positioned a predetermined distance below the heated circular sealer plate to allow the bottom edge of the horizontally disposed pouches to rest thereon.

41. The packaging apparatus of claim 40, wherein the position of the bottom plate in the horizontal rotary seal former is adjustable at varying heights to accommodate pouches of varying lengths.

42. The packaging apparatus of claim 38 wherein the horizontal rotary seal former further includes a bottom plate, said bottom plate having a diameter equivalent to the heated circular sealer plate and is mounted in corresponding rotation with the heated circular sealer plate, said bottom plate being positioned a predetermined distance below the heated circular sealer plate to allow the bottom edge of the horizontally disposed pouches to rest thereon.

43. The packaging apparatus of claim 38, further comprising at least one press roller mounted for counter-rotation in pressing engagement against the rotating circumference of the flat outer surface of the heated circular sealer plate in order to help seal and align the upper portion of the web of horizontally disposed pouches.

44. A method of continuously forming, filling and sealing of packages with a continuous web of film material, comprising the steps of:

a) providing a continuous web of film material;

b) folding the web to provide confronting sides joined along a bottom edge;

c) forming a vertical seal at spaced intervals along the web thereby providing a series of horizontally disposed adjoining pouches having opposed sidewalls with each pouch unsealed along a top edge;

d) opening the pouches by separating the opposed sidewalls;

e) filling the pouches with a material;

f) sealing the top edge of each pouch together to close the filled pouches by training the pouches onto a horizontal rotary sealer having a heated circular sealer plate and progressively forming a continuous horizontal seal as the top edge of each pouch is being continuously moved along with a circumference of the heated circular sealer plate while at the same time applying an adequate temperature to provide a sealing action and allowing the top edge of each pouch to be joined together and smoothly sealed to enclose the filled pouches, and maintaining the web of horizontally disposed adjoining pouches properly aligned while sealing the top edge, wherein the horizontal rotary sealer further includes a land plate and a plurality of lands, the land plate having a diameter slightly smaller than the heated circular sealer plate and being positioned directly below the heated circular sealer plate, the land plate being mounted in corresponding rotation with the circular sealer plate, each of the lands having a relatively rectangular shape and having a thickness less than a thickness of the vertical seals on the series of horizontally disposed adjoining pouches, the plurality of lands being pivotally mounted at an upper end along the outer edge of the land plate allowing each of the lands to freely pivot radially inward and extend vertically downward from the land plate, the plurality of lands being equally spaced about the circumference of the land plate wherein the distance between each land is equivalent to the distance between the vertical seals on the series of horizontally disposed adjoining pouches, whereby when the horizontally disposed adjoining pouches are trained onto the horizontal rotary sealer to join and seal the upper portion of the adjoining pouches, the vertical seals extending below the top edge of the pouches will engage with the lands and curve radially inward in engagement with the lands, thereby helping to keep the horizontally disposed adjoining pouches properly aligned; and g) supporting a bottom portion of each pouch while sealing the top edge, wherein the horizontal rotary sealer further includes a bottom plate, the bottom plate being mounted in corresponding rotation with the heated circular sealer plate and is positioned a predetermined distance below the heated circular sealer plate to allow the bottom portion of the horizontally disposed adjoining pouches to rest thereon.

45. The method of claim 44, wherein the position of the bottom plate is adjustable at varying heights to accommodate pouches of different heights.

46. A method of continuously forming, filling and sealing of packages with a continuous web of film material, comprising the steps of:

a) providing a continuous web of film material;

b) folding the web to provide confronting sides joined along a bottom edge;

c) forming a vertical seal at spaced intervals along the web thereby providing a series of horizontally disposed adjoining pouches having opposed sidewalls with each pouch unsealed along a top edge;

d) opening the pouches by separating the opposed sidewalls;

e) filling the pouches with a material;

f) sealing the top edge of each pouch together to close the filled pouches by training the pouches onto a horizontal rotary sealer having a heated circular sealer plate and progressively forming a continuous horizontal seal as the top edge of each pouch is being continuously moved along with a circumference of the heated circular sealer plate while at the same time applying an adequate temperature to provide a sealing action and allowing the top edge of each pouch to be joined together and smoothly sealed to enclose the filled pouches, and maintaining the web of horizontally disposed adjoining pouches properly aligned while sealing the top edge, wherein the horizontal rotary sealer further includes a land plate and a plurality of lands, the land plate having a diameter slightly smaller than the heated circular sealer plate and being positioned directly below the heated circular sealer plate, the land plate being mounted in corresponding rotation with the circular sealer plate, each of the lands having a relatively rectangular shape and having a thickness less than a thickness of the vertical seals on the series of horizontally disposed adjoining pouches, the plurality of lands being pivotally mounted at an upper end along the outer edge of the land plate allowing each of the lands to freely pivot radially inward and extend vertically downward from the land plate, the plurality of lands being equally spaced about the circumference of the land plate wherein the distance between each land is equivalent to the distance between the vertical seals on the series of horizontally disposed adjoining pouches, whereby when the horizontally disposed adjoining pouches are trained onto the horizontal rotary sealer to join and seal the upper portion of the adjoining pouches, the vertical seals extending below the top edge of the pouches will engage with the lands and curve radially inward in engagement with the lands, thereby helping to keep the horizontally disposed adjoining pouches properly aligned; and g) wherein the horizontal rotary sealer further includes at least one press roller mounted for counter-rotation in pressing engagement against the rotating circumference of the heated circular sealer plate in order to help seal and align the top edge of the web of horizontally disposed pouches.

47. A method of continuously forming, filling and sealing of packages with a continuous web of film material, comprising the steps of:

a) providing a continuous web of film material;

b) folding the web to provide confronting sides joined along a bottom edge;

c) forming a vertical seal at spaced intervals along the web thereby providing a series of horizontally disposed adjoining pouches having opposed sidewalls with each pouch unsealed along a top edge;

d) opening the pouches by separating the opposed sidewalls;

e) filling the pouches with a material; and f) sealing the top edge of each pouch together to close the filled pouches by training the pouches onto a horizontal rotary sealer, said horizontal rotary sealer having a heated circular sealer plate and vertical alignment means, said vertical alignment means allowing the opposed sidewalls of each filled pouch to remain in alignment with the vertical regardless of the quantity of material used to fill each of said pouches, progressively forming a continuous horizontal seal as the top edge of each pouch is being continuously moved along with a circumference of the heated circular sealer plate while at the same time applying an adequate temperature to provide a sealing action and allowing the top edge of each pouch to be joined together and smoothly sealed to enclose the filled pouches.

48. A method of forming a horizontal top seal for use in a packaging machine having a continuous web of film material having a series of horizontally disposed filled pouches separated by vertical seals extending transversely of the web and having opposed sidewalls of each pouch unsealed along a top edge, the method comprising training the horizontally disposed filled pouches onto a horizontal rotary sealer said horizontal rotary sealer having a heated circular sealer plate and vertical alignment means, said vertical alignment means allowing the opposed sidewalls of each filled pouch to remain in alignment with the vertical regardless of the quantity of material used to fill each of said pouches, progressively forming a continuous horizontal seal as the top edge of each pouch is being continuously moved along with a circumference of the heated circular sealer plate while at the same time applying an adequate temperature to provide a sealing action and allowing the top edge of each pouch to be gently joined together and smoothly sealed to enclose the filled pouches.

49. A packaging apparatus, comprising:

a) means for feeding a continuous web of film material having confronting sides;

b) means for forming vertical seals in the web to form a series of horizontally disposed pouches separated by the vertical seals, the vertical seals extending transversely of the web from a bottom edge of the pouch to an upper portion of the pouch;

c) means for opening the pouches by separating opposed sidewalls of the pouches;

d) means for filling the pouches with a material to form outwardly bulged sidewalls; and e) a horizontal rotary seal former having a heated circular sealer plate mounted for rotation and a vertical alignment means, the heated circular sealer plate having a flat outer surface positioned about its circumference for engagement with an upper portion of the pouches for progressively forming a continuous horizontal seal as the web is being continuously moved along with the circumference of the heated circular sealer plate while at the same time applying an adequate temperature to provide a sealing action and allowing the upper portion of the pouches to be joined together and smoothly sealed, said vertical alignment means allowing the opposed sidewalls of each filled pouch to remain in alignment with the vertical regardless of the magnitude of the outward bulge of the sidewalls of each of said pouches.

50. A horizontal seal former device for use with a continuous web of film material having confronting sides and a series of horizontally disposed filled pouches defined by a series of vertical seals extending transversely of the web from a bottom edge of the pouch to an upper portion of the pouch, the device comprising: a top seal shaft, said top seal shaft being connected to a rotating means for rotating said top seal shaft, a heated circular sealer plate mounted for rotation on said top seal shaft, said circular sealer plate having an upper portion comprising a flat outer surface positioned about its circumference for engagement with an upper portion of a continuous web of filled pouches for progressively forming a continuous horizontal seal as the web is moved along with the rotating circumference of the flat outer surface while at the same time applying an adequate temperature to provide a sealing action and allowing the upper portion of the pouches to be joined together and smoothly sealed to enclose the filled pouches, said circular sealer plate having a lower portion comprising a vertical alignment means, said vertical alignment means allowing said filled pouches to remain in a vertical orientation adjacent to the circular sealer plate regardless of the extent of bulge of the filled pouches.

51. A method of continuously forming, filling and sealing of packages with a continuous web of film material, comprising the steps of:

a) providing a continuous web of film material;

b) folding the web to provide confronting sides joined along a bottom edge;

c) forming a vertical seal at spaced intervals along the web thereby providing a series of horizontally disposed adjoining pouches having opposed sidewalls with each pouch unsealed along a top edge;

d) opening the pouches by separating the opposed sidewalls;

e) filling the pouches with a material to form outwardly bulged sidewalls; and f) radially and circumferentially moving the open filled pouches in union with a circumferentially moving heated circular sealer plate while at the same time applying an adequate temperature to provide a sealing action and allowing the top edges of each pouch to be joined together and smoothly sealed to enclose the filled pouches, said moving heated circular sealer plate also comprising a vertical alignment means, said vertical alignment means allowing the opposed sidewalls of each filled pouch to remain in alignment with the vertical regardless of the magnitude of the outward bulge of the sidewalls of each of said pouches.

* * * * *